United States Patent [19]

Ishizaki et al.

[11] Patent Number: 4,599,050

[45] Date of Patent: Jul. 8, 1986

[54] DEVICE FOR CONTROLLING DISPLACEMENT OF VARIABLE DISPLACEMENT HYDRAULIC PUMP

[75] Inventors: Naoki Ishizaki; Koichi Morita, both of Kamakura, Japan

[73] Assignee: Kabushiki Kaisha Komatsu Seisakusho, Tokyo, Japan

[21] Appl. No.: 698,470

[22] Filed: Feb. 5, 1985

[30] Foreign Application Priority Data

Feb. 8, 1984 [JP] Japan ..... 59-15364

[51] Int. Cl.[4] ..... F04B 49/00

[52] U.S. Cl. ..... 417/216; 417/218; 417/222

[58] Field of Search ..... 417/213, 216, 218, 222; 60/447, 452

[56] References Cited

U.S. PATENT DOCUMENTS

| | | | |
|---|---|---|---|
| 3,985,472 | 10/1976 | Virtue et al. | 417/216 |
| 4,248,574 | 2/1981 | Uehara et al. | 417/216 |
| 4,498,847 | 2/1985 | Akiyama | 417/222 X |

FOREIGN PATENT DOCUMENTS

| | | | |
|---|---|---|---|
| 11302 | 2/1978 | Japan | 417/216 |
| 13202 | 2/1978 | Japan | 417/216 |
| 14002 | 2/1979 | Japan | 417/218 |
| 108002 | 8/1979 | Japan | 417/218 |

*Primary Examiner*—William L. Freeh
*Assistant Examiner*—Paul F. Neils
*Attorney, Agent, or Firm*—Armstrong, Nikaido, Marmelstein & Kubovcik

[57] ABSTRACT

Disclosed herein is a device for controlling displacement of a variable displacement hydraulic pump comprising a displacement control system for receiving a discharge pressure of the variable displacement hydraulic pump and a discharge pressure of a fixed displacement hydraulic pump to control the displacement of the variable displacement hydraulic pump. The displacement control system comprises a servopiston including a helical compression spring for maintaining the variable displacement hydraulic pump at a maximum swash angle in a neutral position of associated operating valve, a servovalve including a spool for selectively controlling communication of hydraulic pressure between a control pump and a pair of fluid chambers defined in the servopiston, a control piston connected through a control lever pivotably supported by a pivot pin to the spool and the servopiston, at least two helical compression springs for biasing the control piston and controlling torque and flow so as to approximate same to a constant torque curve, a floating spring seat interposed between the helical compression springs, and a guide rod for guiding the floating spring seat and accommodated in a bore formed in the housing at a base portion thereof to define a pressure chamber pressurized by a biasing spring, the pressure chamber being communicated through a conduit to a discharge passage of the fixed displacement hydraulic pump.

1 Claim, 4 Drawing Figures

DEVICE FOR CONTROLLING DISPLACEMENT OF VARIABLE DISPLACEMENT HYDRAULIC PUMP

BACKGROUND OF THE INVENTION (1) Field of the Invention

This invention relates to a device for controlling displacement of a variable displacement hydraulic pump adapted to be driven with a fixed displacement hydraulic pump by a common prime mover.

(2) Description of the Prior Art

In the prior art device for controlling displacement of a variable displacement hydraulic pump as driven by a prime mover, pressure in a discharge pipe of the variable displacement hydraulic pump is detected, and displacement is controlled to be increased or decreased in response to the pressure to render a drive torque of the variable displacement hydraulic pump constant and thereby to maintain an output of the prime mover at a constant level.

In the case that both the variable displacement hydraulic pump and a fixed hydraulic pump are driven by a common prime mover, as the output of the prime mover is fluctuated in association with fluctuation in load of the fixed displacement hydraulic pump, reduction in a rotational speed of the prime mover is detected as excess of load of the prime mover (overload of the fixed hydraulic pump) as well as displacement control of the variable displacement hydraulic pump, and according to such detection, the displacement of the variable displacement hydraulic pump is reduced to maintain the output of the prime mover at a constant level.

However, since such a control device as above is designed to detect reduction in engine rotational speed and input a detection signal to a displacement control system of the variable displacement hydraulic pump to control the displacement, there will be created delay of reponse time, and stable displacement control may not be provided.

SUMMARY OF THE INVENTION

Accordingly, it is an object of the present invention to provide a device for controlling displacement of a variable displacement hydraulic pump which may control the displacement stably by inputting load fluctuations of the variable displacement hydraulic pump and the fixed displacement hydraulic pump to the displacement control system without delay of response time, and maintain an input torque of the prime mover at a constant level.

According to the present invention, the device for controlling displacement of at least a variable displacement hydraulic pump comprises a displacement control system for receiving a discharge pressure of the variable displacement hydraulic pump and a discharge pressure of a fixed displacement hydraulic pump to control the displacement of the variable displacement hydraulic pump. The displacement control system comprises a servopiston including a helical compression spring for maintaining the variable displacement hydraulic pump at a maximum swash angle in a neutral position of associated operating value, a servovalve including a spool for selectively controlling communication of hydraulic pressure between a control pump and a pair of fluid chambers defined in the servopiston, a control piston connected through a control lever pivotably supported by pivot pin to the spool and the servopiston, at least two helical compression springs for biasing the control piston and controlling torque and flow so as to approximate same to a constant torque curve, a floating spring seat interposed between the helical compression springs, and a guide rod for guiding the floating spring seat and accommodated in a bore formed in the housing at a base portion thereof to define a pressure chamber pressurized by a biasing spring, the pressure chamber being communicated through a conduit to a discharge passage of the fixed displacement hydraulic pump.

Other objects and advantages of the invention will become apparent from the following description and accompanying drawings.

DETAILED DESCRIPTION OF THE PREFERRED EMBODIMENT

Figure 1:
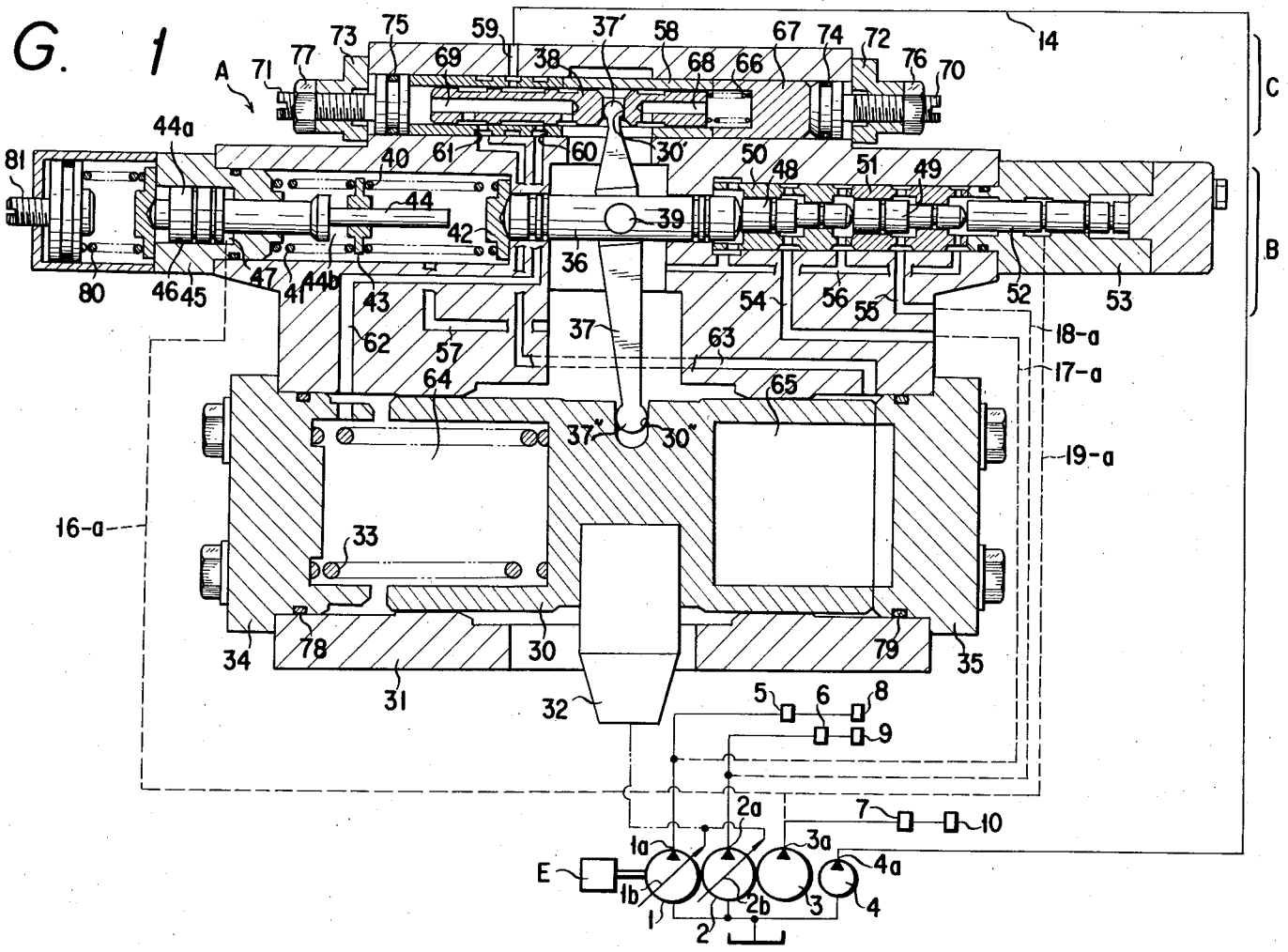
FIG. 1 is a diagrammatic representation, in section, of the displacement control device according to the present invention.

Referring to FIG. 1, reference numerals 1, 2, 3 and 4 designate first and second variable displacement hydraulic pumps, a fixed displacement hydraulic pump and a control pump, respectively, which are driven by a common prime mover E. Discharge conduits 1*a*, 2*a* and 3*a* of the first and second variable hydraulic pumps 1 and 2 and the fixed hydraulic pump 3 are connected through operating valves 5, 6 and 7 to hydraulic equipments 8, 9 and 10. A discharge conduit 4*a* of the control pump 4 is connected to a displacement control system A.

The displacement control system A comprises a servopiston 30 accommodated in a housing 31 and connected through a rod or actuator arm 32 to swash plates 1*b* and 2*b* of the first and second variable hydraulic pumps 1 and 2, a helical compression spring 33 for maintaining the swash plates 1*b* and 2*b* of the first and second variable displacement hydraulic pumps 1 and 2 at a maximum angle in a neutral position of the operating valves 5 and 6, end covers 34 and 35 fixed by bolts and the like to the housing 31 and seal members 78 and 79.

Symbols B and C designate an input signal section of the displacement control system and a guide valve section of the displacement control system, respectively.

In the input signal section B, a control piston 36 is connected through a control lever 37 to a spool 38 and the servopiston 30. The control lever 37 is connected through a pivot pin 39 to the control piston 36. The control lever 37 is connected to the spool 38 and the servopiston 30 in such a manner that respective spherical portions 37' and 37'' are engaged with respective recesses 30' and 30''.

First and second helical compression springs 40 and 41 for controlling torque and flow, respectively, are used for purpose of approximation to a constant torque curve by two-step straight lines. In case of approximation by three-step straight lines, three similar compression springs may be used.

Reference numerals 42 and 44 designate a spring seat of the first spring 40 and a guide rod for a floating spring seat 43 of the first and second springs 40 and 41, respectively. The guide rod 44 serves to adjust an intermediate point of a broken line approximate to the constant torque curve. A spring seat 45 of the second spring 41 serving as an end cover for guiding the guide rod 44 is formed with a bore 46 engaging with a large diametrical portion of the guide rod 44 to define a first pressure chamber 47. The guide rod 44 is biased rightwardly by a spring 80, and a biasing force of the spring 80 may be adjusted by an adjusting screw 81. The first pressure chamber 47 is connected through a conduit 16-*a* to the discharge conduit 3*a* of the fixed displacement hydraulic pump 3. Reference numeral 57 designates a drain passage.

A biasing piston 48 receives at its shoulder portion a discharge pressure (self pressure) of the first variable displacement hydraulic pump 1 as transmitted through a conduit 17-*a*. The piston 48 is inserted in a guide sleeve 50. Similarly, a biasing piston 49 receives at its shoulder portion a discharge pressure of the second variable hydraulic pump 2 as transmitted through a conduit 18-*a*, and is inserted in a guide sleeve 51. Further, a piston 52 receives at its shoulder portion a discharge pressure of the fixed displacement hydraulic pump 3 as transmitted through a conduit 19-*a*, and is inserted in an end cover 53.

A passage 54 is formed in the housing 31 for communicating the conduit 17-*a* with the shoulder portion of the piston 48. Similarly, a passage 55 is formed in the housing 31 for communicating the conduit 18-*a* with the shoulder portion of the piston 49. A drain passage 56 is also formed in the housing 31.

In the valve guide section C, reference numeral 58 designates a guide sleeve in which the spool 38 is inserted. A hydraulic oil is fed from the control pump 4 through a conduit 14 to a passage 59. An outlet port 60 is communicated through a passage 62 to a first fluid chamber 64 of the servopiston 30, while an outlet port 61 is communicated through a passage 63 to a second fluid chamber 65 of the servopiston 30.

A spring 66 serves to prevent rattle among the control lever 37, spool 38 and servopiston 30, which spring 66 is seated on a spring seat 67. Reference numerals 68 and 69 designate drain passages.

Plugs or adjust screws 70 and 71 serve to change a position of the guide sleeve 58 to adjust a neutral position or an operating position of the displacement control system. The plugs 70 and 71 are threadedly engaged with end covers 72 and 73 and adapted to be moved in right and left directions so as to change the position of the sleeve 58.

The end covers 72 and 73 are fixed by bolts and the like to the housing 31. Reference numerals 72 and 75 designate seal members, and 76 and 77 designate lock nuts for the plugs 70 and 71.

(1) In operation, provided that a discharge pressure of the fixed displacement hydraulic pump 3 is zero, when the operating valves 5 and 6 are in a neutral position, that is, a discharge pressure of the first and second variable displacement hydraulic pumps 1 and 2 is under no load, the discharge pressure of the first and second variable displacement hydraulic pumps 1 and 2 as an input signal pressure to the displacement control system is zero, and accordingly there is created no force as leftwardly applied to the shoulder portions of the pistons 48 and 49.

A rightward biasing force of the first and second springs 40 and 41 is strong, and accordingly, the pistons 36, 48, 49 and 52 are rightwardly biased. At this time, a right-hand end of the piston 52 is in abutment against the end cover 53.

Under such a condition as above, a control hydraulic pressure transmitted through the conduit 14 is introduced through the passage 59, the outlet port 60 and the passage 62 to the first fluid chamber 64 of the servopiston 30. The second fluid chamber 65 of the servopiston 30 is communicated through the passage 63 and the outlet port 61 to the drain passage 69, and a discharge amount of the variable displacement pump 1 is maintained at a maximum displacement Qmax.

(2) Then, when both of the operating valves 5 and 6 are operated or either is operated to increase a discharge pressure of the first and second hydraulic pumps 1 and 2, pressure loaded on the shoulder portions of the pistons 48 and 49 is increased in the same manner as with the first and second hydraulic pumps 1 and 2, and therefore a leftward force is increased to compress the second spring 41.

If the discharge pressures of the first and second variable displacement hydraulic pumps 1 and 2 are defined as Pa1 and Pa2, respectively, the leftward force created by the pressure applied on the shoulder portions of the pistons 48 and 49 and the discharge pressure of the first and second variable displacement hydraulic pumps 1 and 2 acts to compress the second spring 41 and leftwardly move the piston 36 until $(Pa1+Pa2)/2=\{(Pa1+Pa2)/2\}L$ is reached. As a result, the spool 38 is also leftwardly moved, and an opening area between the control hydraulic passage 59 and the outlet port 60 is decreased.

When the condition of $(Pa1+Pa2)/2=\{(Pa1+Pa2)/2\}L$ is reached, the control hydraulic passage 59 is not communicated with both the outlet ports 60 and 61 by the movement of the spool 38.

(3) Next, when the discharge pressure of the first and second variable displacement hydraulic pumps 1 and 2 is further increased, the second spring 41 is further compressed to leftwardly move the piston 36. Accordingly, the spool 38 is also leftwardly moved to communicate the control hydraulic passage 59 with the outlet port 61, while communicating the outlet port 60 with the drain passage 69. As a result, the control hydraulic pressure is delivered through the conduit 14, the passage 59, the outlet port 61 and the passage 63 to the second fluid chamber 65, and the hydraulic oil in the first fluid chamber 64 is drained through the passage 62, the outlet port 60 and the drain passage 69, thereby leftwardly moving the piston 30 and decreasing the discharge amount of the variable pump 1.

The control lever 37 is rotated about the pivot pin 39 by the movement of the piston 30 to rightwardly return the spool 38. Further, when the servopiston 30 is positioned at $(Pa1+Pa2)/2$, the servo hydraulic passage 59 is not communicated with both the outlet ports 60 and 61 to retain a pump discharge amount Q corresponding to $(Pa1+Pa2)/2$.

Until the condition of $(Pa1+Pa2)/2=\{(Pa1+Pa2)/2\}M$ is reached, the second spring 41 is compressed as mentioned above, the pump discharge amount Q corresponding to the discharge pressures of the first and second variable displacement hydraulic pumps 1 and 2 is set.

(4) When the condition of $(Pa1+Pa2)/2=\{(Pa1+Pa2)/2\}M$ is reached, the first spring 40 is brought into abutment through the spring seat 43 against a shoulder 44*b* of the guide rod 44. When the discharge pressure of the first and second variable displacement hydraulic pumps 1 and 2 is further increased, the leftward force acting on the pistons 48 and 49 is increased to compress the first spring 40. In other words, a biasing force of the first spring 40 is set to be larger than that of the second spring 41. Thus, the piston 36 is leftwardly moved to move the spool 38 leftwardly.

As a result, the hydraulic oil in the servo hydraulic passage 59 as is blocked is introduced to the outlet port 61, and the hydraulic oil at the outlet port 60 is introduced to the drain passage 69. Accordingly, as is similar to the previous paragraph (3), the servopiston 30 is leftwardly moved to decrease the discharge amount of the first and second variable displacement hydraulic pumps 1 and 2. The control lever 37 is rotated about the pivot pin 39 by the leftward movement of the servopiston 30 to rightwardly return the spool 38.

When the servopiston 30 is positioned at (Pa1+Pa2)/2, the servo hydraulic passage 59 is brought into non-communication with both the outlet ports 60 and 61 to retain the pump discharge amount Q corresponding to (Pa1+Pa2)/2. Under the condition of (Pa1+Pa2)/2={(Pa1+Pa2)/2}M, a left-hand end of the piston 30 is in abutment against the end cover 34, and a minimum displacement Qmin of the first and second variable displacement hydraulic pumps 1 and 2.

In the case that the discharge pressure of the first and second variable displacement pumps 1 and 2 is decreased, operation is inverted with respected to the previous paragraphs (3) and (4).

Figure 2:
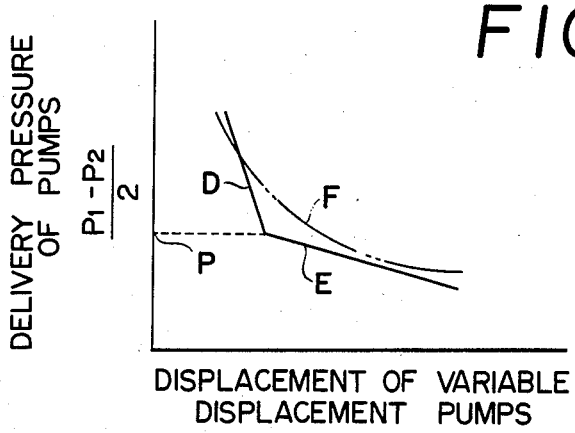
FIGS. 2, 3 and 4 are graphs showing a relation between the discharge pressure and the displacement of first and second variable displacement hydraulic pumps.

As is above described, until the discharge pressure of the first and second variable displacement hydraulic pumps 1 and 2 reaches a given pressure, the first spring 40 is operated, and when the discharge pressure exceeds the given pressure, both the first and second springs 40 and 41 are operated. Consequently, as shown in FIG. 2, the relation between the displacement and the discharge pressure of the first and second variable displacement hydraulic pumps 1 and 2 is such that two-step straight lines D and E of different gradient as broken at a given pressure P* are given. Thus, the displacement is controlled under such two-step straight lines condition approximated to a number horse-power curve F.

Figure 3:
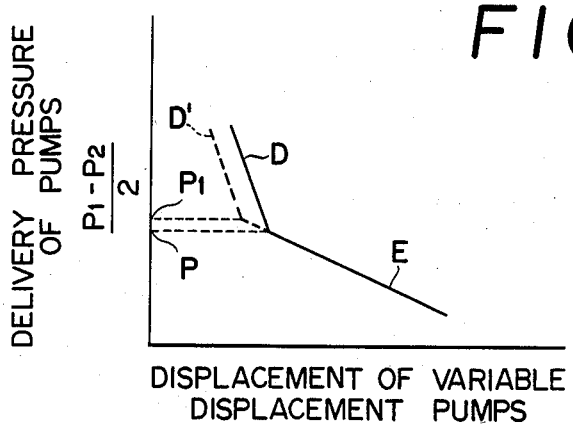

Further, a discharge pressure of the fixed displacement hydraulic pump 3 is supplied to the first pressure chamber 47, and therefore when the discharge pressure is increased, the guide rod 44 is leftwardly moved against a biasing force of the spring 80. Accordingly, a stroke of the spring seat 43 to the abutment against the shoulder **44*b* is elongated, and a discharge pressure of the first and second variable displacement hydraulic pumps 1 and 2 upon starting of compression of the second spring 41** is raised, resulting in increase in the pressure P* in FIG. 2 to P1 as shown in FIG. 3 and change from the straight line D to D'.

Figure 4:
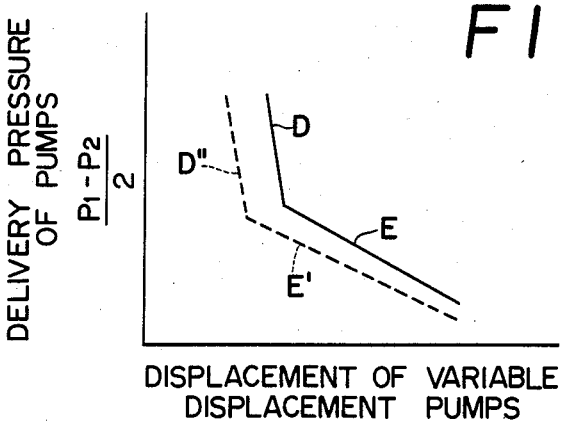

As the discharge pressure of the fixed displacement hydraulic pump 3 is applied on the piston 52, the leftward force urging the piston 36 is increased, and resultantly the discharge pressure (Pa1+Pa2)/2 in FIG. 2 is raised, thereby permitting the straight lines D and E to be moved in parallel to the straight lines D'' and E' as shown in FIG. 4, and rendering the displacement of the first and second variable displacement hydraulic pumps 1 and 2 smaller than the discharge pressure thereof.

In this connection, it is possible to maintain constant a torque for driving the first and second variable displacement hydraulic pumps 1 and 2 and the fixed displacement hydraulic pump 3, and maintain an input torque from the prime mover E at a constant level.

Further, since the discharge pressures of the first and second variable displacement pumps 1 and 2 and the fixed displacement hydraulic pump 3 are inputted to the displacement control system, load fluctuation of each pump may be inputted without delay, and therefore stable displacement control may be attained.

While the invention has been described with reference to the specific embodiment, the description is illustrative and is not to be construed as limiting the scope of the invention. Various modifications and changes may occur to those skilled in the art without departing from the spirit and scope of the invention as defined by the appended claims.

What is claimed is:

1. A device for controlling displacement of at least one variable displacement hydraulic pump comprising a displacement control system for receiving a discharge pressure of said variable displacement hydraulic pump and a discharge pressure of a fixed displacement hydraulic pump to control the displacement of said variable displacement hydraulic pump, wherein said displacement control system comprises in a housing:

a servopiston including a helical compression spring for maintaining said variable displacement hydraulic pump at a maximum swash angle in a neutral position of an associated operating valve, a servovalve including a spool for selectively controlling communication of hydraulic pressure between a control pump and a pair of fluid chambers defined in said servopiston, a control piston connected through a control lever pivotably supported by a pivot pin to said spool and said servopiston, an input signal section for receiving the delivery pressures of said fixed and variable displacement hydraulic pumps, at least two helical compression springs for biasing said control piston and controlling torque and flow so as to approximate same to a constant torque curve, a floating spring seat interposed said helical compression springs, and a guide rod for guiding said floating spring seat and accommodated in a bore formed in the housing at a base portion thereof to define a pressure chamber, said pressure chamber being communicated through a conduit to a discharge passage of said fixed displacement hydraulic pump, and said guide rod being spring biased toward the control piston so as to reduce the pressure chamber.

* * * * *